US012012718B2

(12) United States Patent
Harris

(10) Patent No.: US 12,012,718 B2
(45) Date of Patent: Jun. 18, 2024

(54) DITCH CUTTER AND SPOIL REMOVAL APPARATUS

(71) Applicant: Tilden Craig Harris, St. Gabriel, LA (US)

(72) Inventor: Tilden Craig Harris, St. Gabriel, LA (US)

( * ) Notice: Subject to any disclaimer, the term of this patent is extended or adjusted under 35 U.S.C. 154(b) by 666 days.

(21) Appl. No.: 17/064,768

(22) Filed: Oct. 7, 2020

(65) Prior Publication Data

US 2021/0115646 A1 Apr. 22, 2021

Related U.S. Application Data

(60) Provisional application No. 62/973,627, filed on Oct. 16, 2019.

(51) Int. Cl.
*E02F 5/02* (2006.01)
*E02F 7/02* (2006.01)
*E02F 9/00* (2006.01)

(52) U.S. Cl.
CPC ..... *E02F 5/027* (2013.01); *E02F 7/02* (2013.01); *E02F 9/003* (2013.01)

(58) Field of Classification Search
CPC ... E02F 5/02; E02F 5/022; E02F 5/025; E02F 5/027; E02F 5/14; E02F 5/145
USPC ..... 37/269, 380, 366, 404, 220, 215, 272
See application file for complete search history.

(56) References Cited

U.S. PATENT DOCUMENTS

| | | | | |
|---|---|---|---|---|
| 311,668 A | | 2/1885 | Murray et al. | |
| RE11,516 E | * | 12/1895 | Davy | 37/404 |
| 721,230 A | | 2/1903 | Pinion | |
| 811,424 A | | 1/1906 | Mikolasek | |
| 979,255 A | * | 12/1910 | Brown | E01H 4/02 172/170 |
| 1,277,118 A | | 8/1918 | Quenneville | |
| 1,359,376 A | | 11/1920 | Hiniker | |
| 1,743,532 A | | 1/1930 | Crow et al. | |
| 2,311,551 A | * | 2/1943 | Laird | E02F 3/7631 37/366 |
| 2,745,328 A | * | 5/1956 | Brimhall | E02F 3/7604 172/11 |
| 2,787,847 A | * | 4/1957 | Arps | E02F 3/7627 172/445.2 |
| 2,952,929 A | * | 9/1960 | Lindberg | E02F 3/7604 405/181 |

(Continued)

FOREIGN PATENT DOCUMENTS

JP 2003336765 A 11/2003

*Primary Examiner* — Jamie L McGowan

(57) ABSTRACT

A ditch cutting and excavation spoil removal apparatus creates ditches and land contours while simultaneously removing excavation spoil from the banks of newly created ditches. The apparatus includes an excavation spoil collection box and an adjustable plow saddle that supports a plowshare. The spoil collection box has a vertically adjustable rectangular frame with an open front and bottom. The pivotally mounted plow saddle may be tilted upward and downward through the bottom of the excavation box frame for adjustment of the plowshare and, correspondingly, the depth of the ditch being cut. Excavation spoil is collected in the spoil collection box as the apparatus is moved along the ground surface and is removed by raising the spoil collection box.

2 Claims, 7 Drawing Sheets

(56) References Cited

U.S. PATENT DOCUMENTS 2,982,034 A * 5/1961 Perry ..... E02F 5/02 172/449
2,994,142 A * 8/1961 Newell ..... E02F 3/7622 172/684.5
3,734,049 A 5/1973 Humbert
4,048,734 A * 9/1977 Carpenter ..... E02F 5/025 37/367
4,158,923 A * 6/1979 Steiner ..... E01H 5/045 193/2 A
4,320,988 A * 3/1982 Seal ..... E02F 3/7631 172/393
4,326,347 A 4/1982 Ballinger
4,506,741 A * 3/1985 Hula, Jr. ..... A01G 22/22 405/36
4,529,041 A * 7/1985 Black ..... E02F 3/7631 172/445.1
4,779,363 A * 10/1988 Boutrais ..... A01C 3/04 37/405
4,861,199 A 8/1989 Hackmack
4,869,326 A * 9/1989 Hutchins ..... E02F 3/7631 172/197
4,895,211 A * 1/1990 Harris ..... E02F 9/0816 172/698
4,991,662 A * 2/1991 Caron ..... E02F 3/815 172/813
5,172,499 A * 12/1992 Griffin ..... E02F 3/4075 172/684.5
5,392,864 A * 2/1995 Lindenmuth ..... E02F 3/815 172/811
5,599,135 A * 2/1997 Delaurenti ..... E01C 19/187 37/274
5,769,171 A * 6/1998 Newman, IV ..... A01B 31/00 172/199
5,779,390 A * 7/1998 Tuusinen ..... E01C 19/15 404/101
6,021,853 A * 2/2000 Atkins ..... E02F 3/8155 172/776
6,067,733 A * 5/2000 Gasper ..... E02F 3/40 37/444
6,112,438 A * 9/2000 Weagley ..... E01H 5/065 37/270
6,419,418 B1 * 7/2002 Smith ..... B60P 1/16 239/668
6,701,630 B2 * 3/2004 Humphrey ..... E02F 3/401 37/468
6,763,618 B1 * 7/2004 Moran ..... A01B 31/00 37/301
7,021,398 B1 * 4/2006 Marshall ..... E02F 3/34 172/830
7,575,067 B1 * 8/2009 Reyes ..... E02F 3/961 172/684.5
8,544,558 B1 * 10/2013 Seal ..... E02F 3/7663 172/799.5
8,701,313 B2 * 4/2014 Hall ..... E02F 3/40 37/444
8,732,993 B2 * 5/2014 Hruska ..... E02F 3/7604 37/372
8,944,178 B1 * 2/2015 Seal ..... E02F 9/024 172/799.5
9,194,103 B2 11/2015 McGee
10,132,050 B1 * 11/2018 Mandan ..... E02F 3/407
10,337,168 B2 7/2019 Sewell
D863,365 S * 10/2019 LaGrande ..... D15/27
D863,366 S * 10/2019 LaGrande ..... D15/27
10,662,593 B1 * 5/2020 Smith ..... E01C 23/082
2003/0136568 A1 * 7/2003 McReynolds ..... E02F 3/34 172/253
2003/0230421 A1 * 12/2003 Crowley, II ..... A01B 31/00 172/684.5
2011/0297405 A1 * 12/2011 Fraley ..... E02F 3/7622 172/684.5
2012/0311894 A1 * 12/2012 Hruska ..... E02F 3/7604 37/367
2015/0107864 A1 * 4/2015 Carlson ..... A01B 29/048 172/140
2016/0265188 A1 * 9/2016 Kuriger ..... E02F 3/961
2017/0218598 A1 8/2017 McGee
2017/0292244 A1 * 10/2017 Atherton ..... E02F 3/8157
2018/0251951 A1 * 9/2018 Stonum ..... E02F 9/2271
2022/0090352 A1 * 3/2022 Lim ..... E02F 3/844
2022/0195691 A1 * 6/2022 Sawatsky ..... E02F 3/7672
2022/0267986 A1 * 8/2022 Corriher ..... A01B 35/14
2022/0381002 A1 * 12/2022 Nier ..... A01B 35/22

* cited by examiner

DITCH CUTTER AND SPOIL REMOVAL APPARATUS

PRIORITY

This application claims priority to U.S. Provisional Application Ser. No. 62/973,627 filed Oct. 16, 2019 for "The Ditch Box", the entire content of which is incorporated by reference.

FIELD OF INVENTION

The present invention generally relates to the tractor implements and ditch cutting machines and, more particularly, presents a ditch cutting apparatus for the simultaneous excavation of a drainage ditch and the removal of the excavation cutting spoil or overburden from the sides is of ditch.

BACKGROUND OF INVENTION

The installation of shallow drainage ditches and swales are often required by farmers and landowners when a drainage system for a field or pasture is being constructed. Many devices are utilized to create such drainage ditches and swales. Such devices include traditional plows and ditching machines and trenchers that employ rotating cutters or rotating cutting chains. The use of such devices, by their nature, leaves excavation cuttings or spoil at the sides or banks of the ditch or trench.

Excavation spoil left along a ditch bank may impede drainage or create undesirable puddling or water collection and also creates obstacles that may impede the movement of farm and land equipment and implements such as tractors, hay trailers, bailing machines, mowers and the like. Consequently, the removal of excavation spoil after a ditch is constructed is preferable, if not essential, in many situations. Removal of excavation spoil will serve to provide a smooth contour on land, lawn, and pasture surfaces that will enhance mowing and farming operations, and will serve to facilitate drainage by allowing unimpeded movement of rainwater into the area around the excavated ditch. Removal of excavation spoil will also serve to reduce the incidence of damage to farming and landscaping equipment caused by mounds of soil in the ditch area.

In situations where excavation spoil must be removed, the use of traditional plows, trenchers, and ditching machines will require additional equipment and an additional spoil removal operation once ditch excavation is completed. Additional equipment and spoil removal operations will necessarily increase the time and expense associated with digging ditches and land and pasture maintenance. Further, ditch cutting devices that employ rotating cutting blades or chains are often expensive to purchase, subject to breakdown, and may require frequent maintenance which also results in an increase in the overall expense of digging ditches and land and pasture maintenance.

Consequently, a need exists for a ditch cutting device that may be employed both to cut a ditch or swale and simultaneously remove accumulated excavation spoil from the sides of the ditch.

A need also exits for a ditch cutting device and spoil excavation device that is simple in design and inexpensive to purchase, operate and maintain.

A need also exits for a ditch cutting device and spoil excavation device that may be utilized in conjunction with conventional farm tractors, both large and small.

SUMMARY OF INVENTION

The present invention provides a ditch cutting and excavation spoil removal apparatus designed to satisfy the aforementioned needs. The apparatus is designed to create ditches and land contours while simultaneously removing the associated excavation spoil from the banks of newly created ditches. Use of the apparatus described herein will eliminate the need for additional spoil removal equipment such as a grader or a scrapper and will reduce or entirely eliminate the need for subsequent excavation spoil removal operations. The apparatus described herein also provides a mechanism for the ready removal, relocation, and dispersion of excavation spoil at a desired disposal location.

The ditch cutting and excavation spoil removal apparatus described herein has an excavation spoil collection box and a pivotally mounted adjustable V-shaped plow saddle that supports a plow blade or plowshare along its bottom edges. The spoil collection box is comprised of a rectangular frame having an open front, closed side and rear walls, and an open top and bottom. The plow saddle is pivotally mounted within the collection box on a transversely extending plow pivot bar. The pivot bar allows the plow saddle to be tilted or pivoted upward and downward through the open bottom of the excavation box frame for adjustment of the depth of plowshare and, correspondingly, the depth of the ditch or furrow being cut when the apparatus is in use.

Preferably the upward and downward pivotal movement of the plow saddle will be controlled by a plow lift, preferably a double acting hydraulic cylinder actuator. The double acting hydraulic cylinder actuator of the plow lift allows the plow saddle to be tilted upward and downward for on-the-go adjustment of the plow saddle and attached plowshare and, correspondingly, the depth of the ditch or furrow being cut. A flat runner at the base of each side wall of the collection box frame facilitates movement of the ditch cutting and excavation spoil removal apparatus along the ground surface of the field or pasture where the apparatus is being utilized.

The front of the frame of the excavation box has multiple hitch points for selective attachment to a 3-point tractor hitch. These tractor hitches typically have one upper link and two lower links, each articulated to the tractor and the implement being attached. The tractor hitch will also have a hitch lift, typically a single acting hydraulic cylinder actuator, that is connected to the tractor's hydraulic system to raise and lower the tractor hitch links and thereby any attached implements. When the hitch lift is activated, the tractor hitch links will be raised or lifted and when the hitch lift is deactivated, the tractor hitch will fall downward by gravity.

Categories or classes for tractor hitches have been adopted by the American Society of Agricultural Engineers in ASAE S217.12. These categories include 1N, 1, 2N, 2, 3N, 3, 4N and 4 and depend upon the size and horsepower of the tractor being utilized. The use of multiple hitch points allows the ditch cutting and excavation spoil removal apparatus to be attached to different categories of tractor hitches that are used on both small and large horsepower tractors.

The apparatus is used by selecting and attaching desired hitch points on the ditch cutting and excavation spoil removal apparatus to the hitch links of a tractor hitch. Then, actuating the actuating the hitch lift of the tractor's hitch to lift the collection box of the ditch cutting and excavation spoil removal apparatus so that it is no longer in contact with the ground surface. Then actuating the plow lift to tilt the plow saddle and plowshare to an upward position. The tractor with the attached ditch cutting and excavation spoil removal apparatus is then moved to the location where the ditching operation is to commence. The pivotally mounted plow saddle is then tilted or pivoted downward by means of the plow lift on the ditch cutting and excavation spoil removal apparatus to adjust the depth of the plowshare at a desired position.

The tractor's hitch lift is then deactivated to lower the collection box of the ditch cutting and excavation spoil removal apparatus so that it is in contact with the ground surface. The tractor is then moved forward to engage the plowshare with the ground surface to cut a furrow or ditch. The depth of the ditch may be increased or decreased by activating the plow lift. As the tractor moves forward, the excavation spoil from the newly cut ditch is moved upward and outward away from the plowshare and collected at the rear wall of the excavation collection box where it is collected and contained.

The excavation spoil is moved to a desire location away from the newly cut ditch by engaging the plow lift to tilt or pivoted the plow saddle and plowshare upward away from the ground surface and then dragging the ditch cutting and excavation spoil removal apparatus with the contain excavation spoil to a desired location. The excavation collection box is then lifted to a desired position above the ground surface by activation of the tractor hitch so that the collected excavation spoil will spill from the open bottom of the excavation collection box.

The spilled excavation spoil may be spread along the ground surface as desired by dragging the elevated excavation collection box and scraper blade over the spilled excavation spoil by moving the tractor forward or rearward. Adjusting the elevation of the excavation collection box and correspondingly the scraper blade by means of the tractor hitch lift will control the depth of the excavation spoil being spread.

DESCRIPTION OF THE EMBODIMENT

Figure 1:
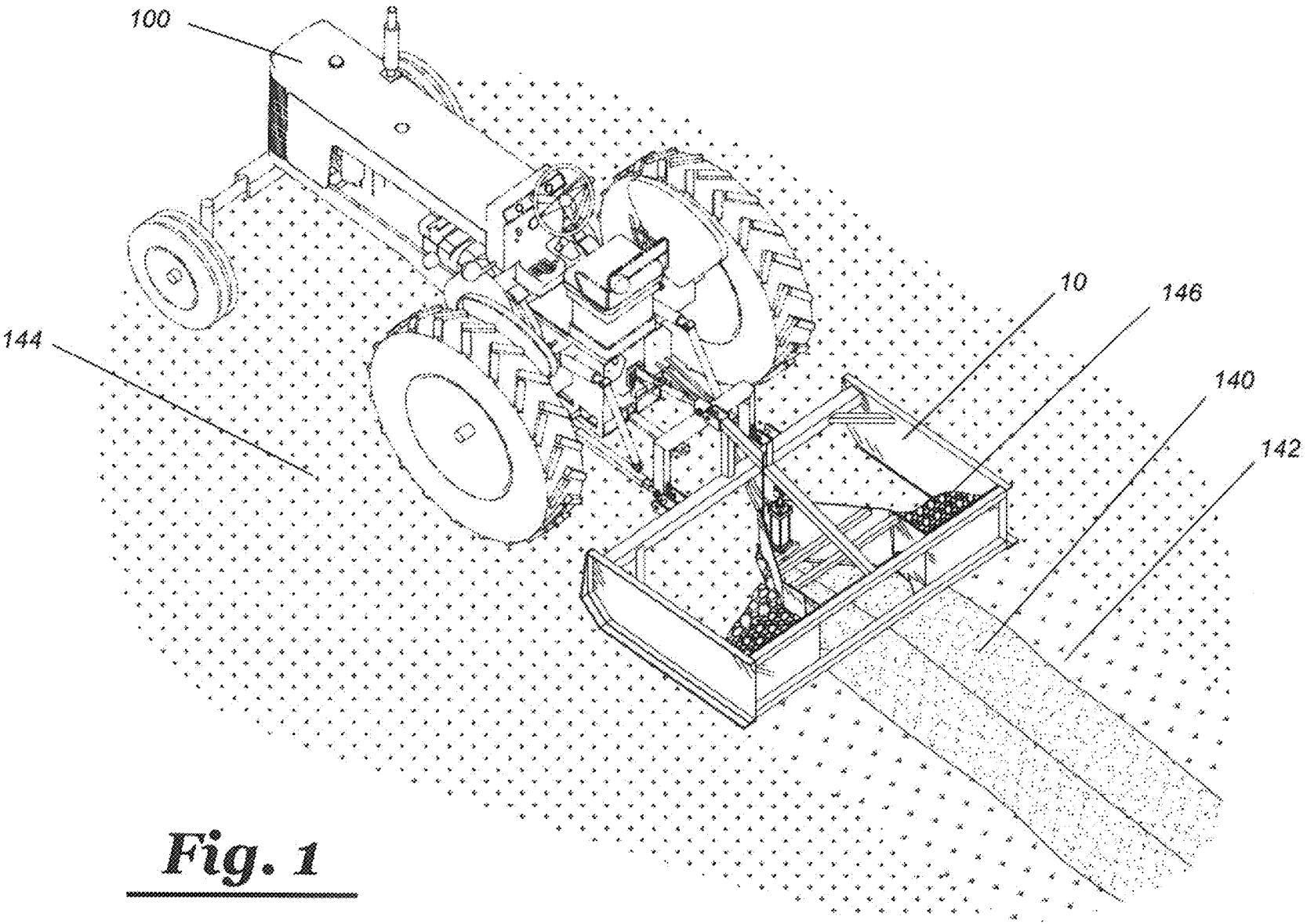
FIG. 1 is a top perspective view of the ditch cutting and excavation spoil removal apparatus of Applicant's invention in use during ditch cutting operations.
Figure 2:
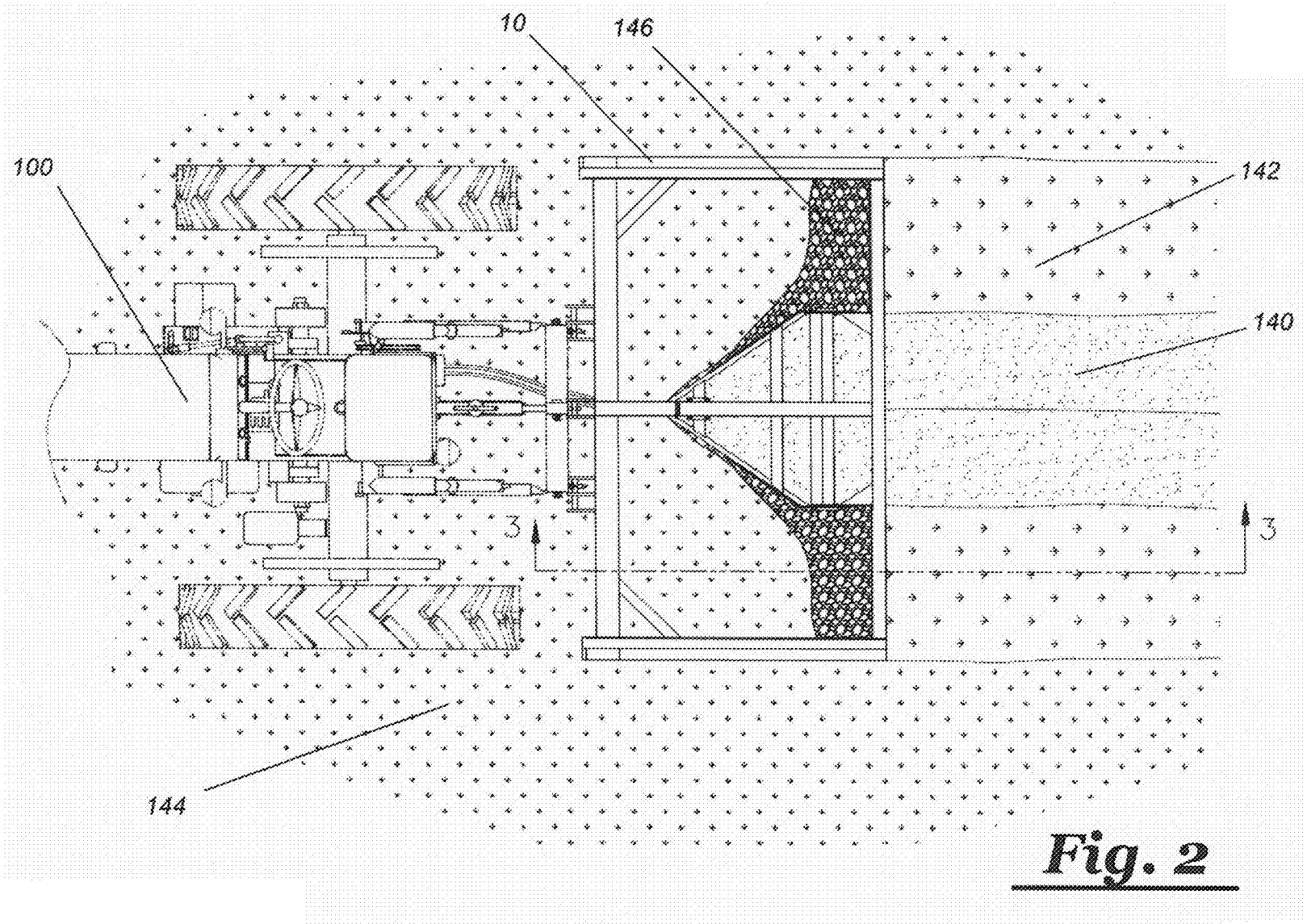
FIG. 2 is a plan view of the ditch cutting and excavation spoil removal apparatus depicted in FIG. 1.
Figure 3:
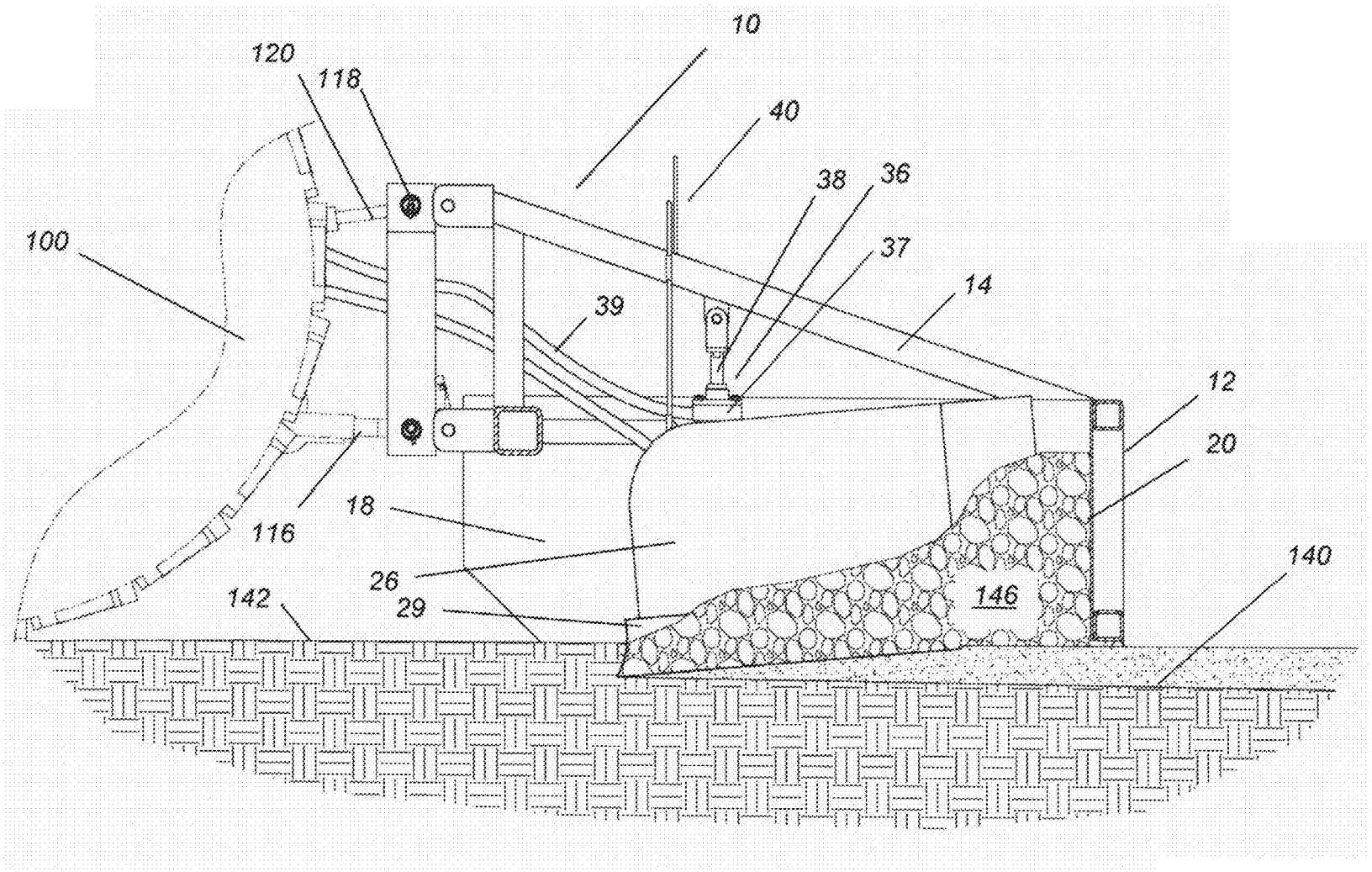
FIG. 3 is a sectional elevation view of the ditch cutting and excavation spoil removal apparatus cut on line 3-3 as depicted in FIG. 2.
Figure 4:
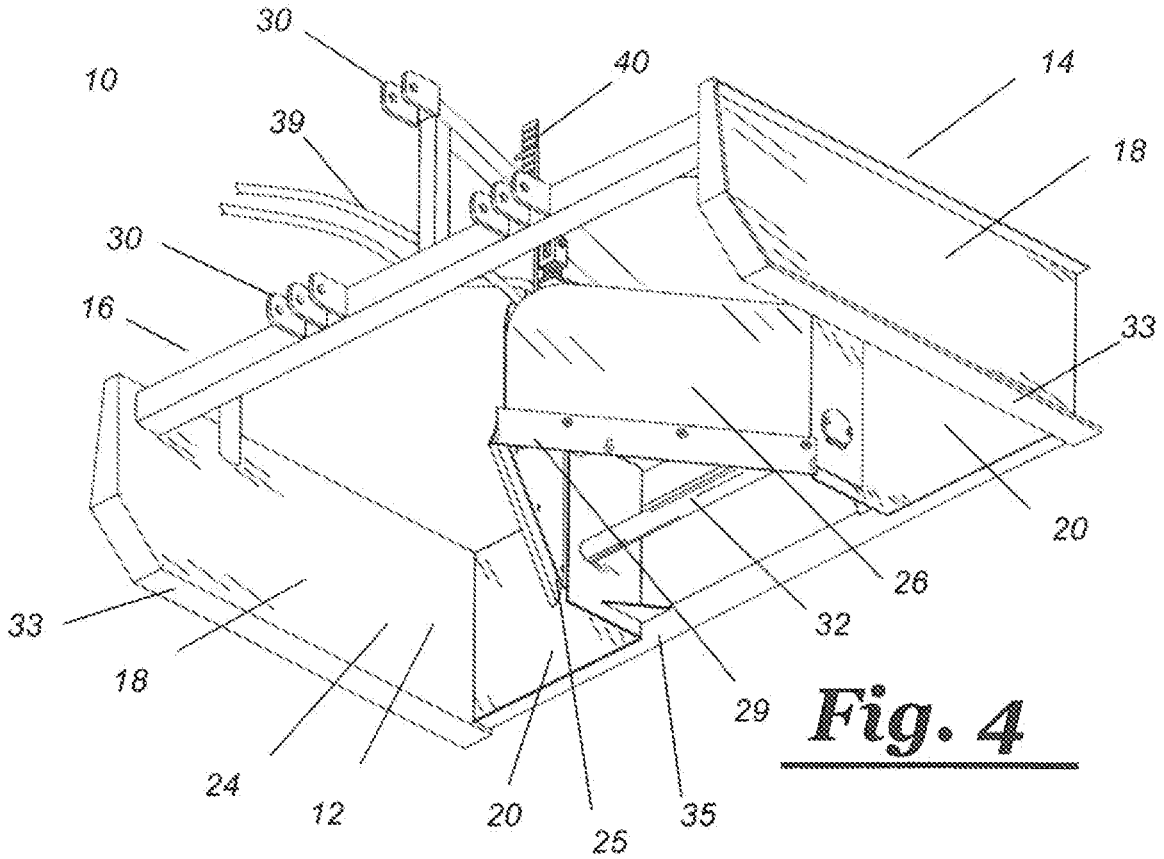
FIG. 4 is a bottom perspective view of the ditch cutting and excavation spoil removal apparatus shown in FIG. 1.
Figure 5:
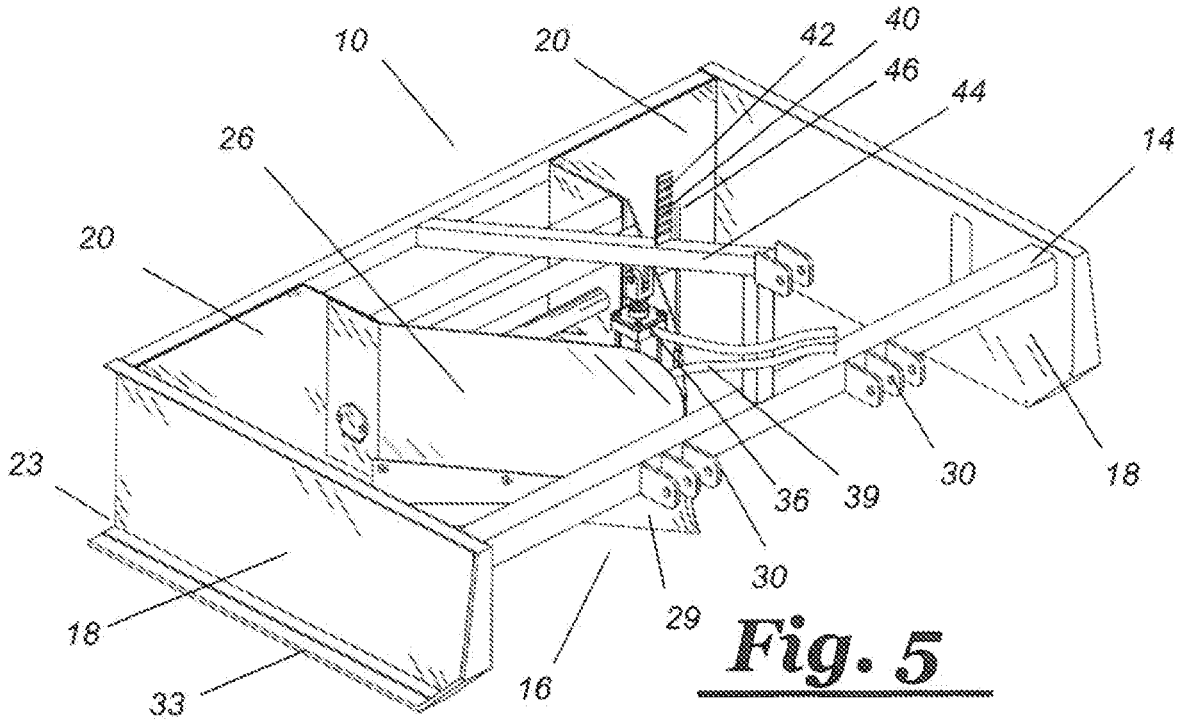
FIG. 5 is a top perspective view of the ditch cutting and excavation spoil removal apparatus shown in FIG. 1.
Figure 6:
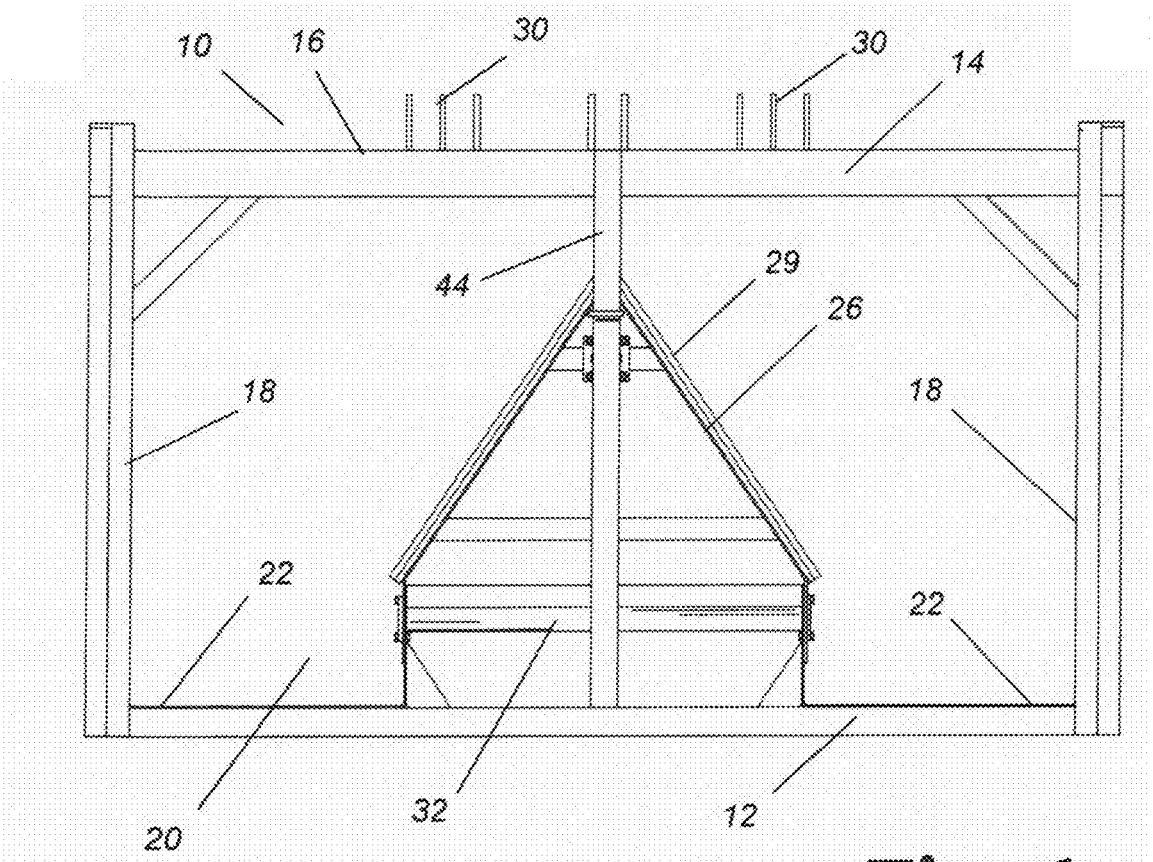
FIG. 6 is a top view of the ditch cutting and excavation spoil removal apparatus shown in FIG. 1.
Figure 7:
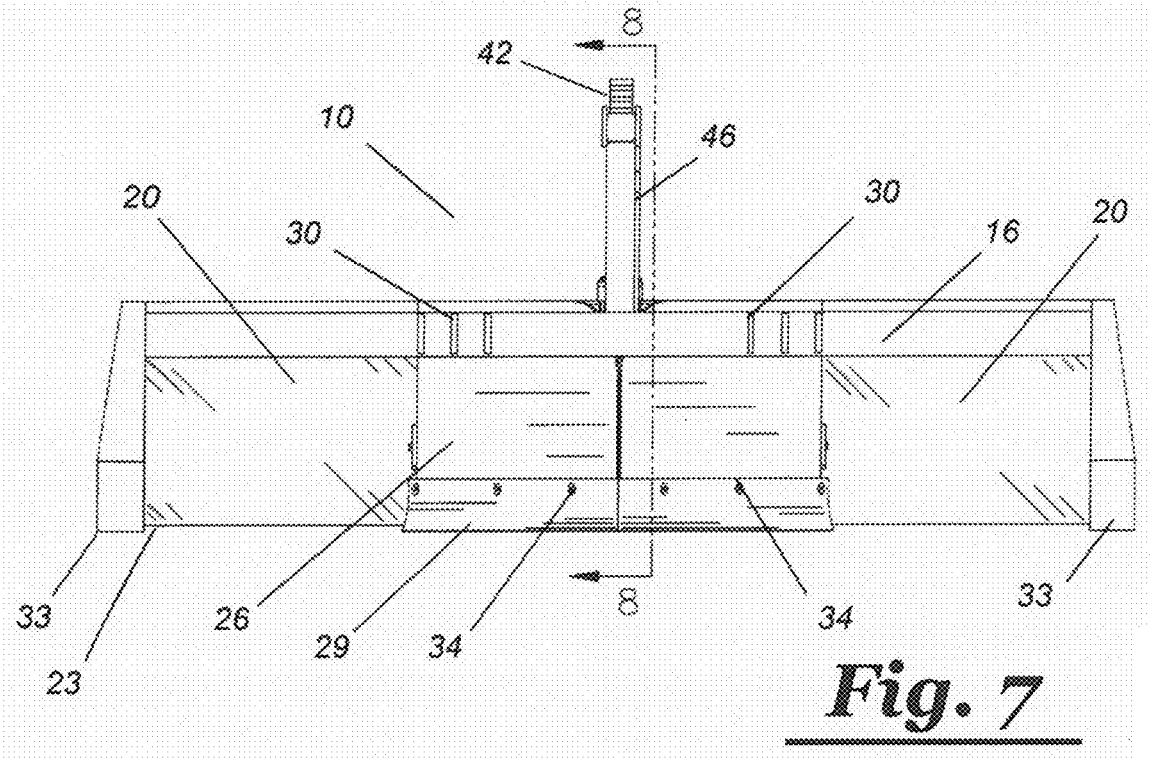
FIG. 7 is a front view of the ditch cutting and excavation spoil removal apparatus shown in FIG. 1.

Referring now to the drawings and more particularly to FIGS. 1-3, there is shown the ditch cutting and excavation spoil removal apparatus (10) of Applicant's invention attached to and pulled behind a vehicle such as tractor (100). The apparatus (10) is typically employed for cutting a furrow or ditch (140) into the ground surface (142) of a pasture or field (144) and simultaneously capturing the associated excavation spoil (146).

The apparatus (10), shown in detail in FIGS. 4-7, is comprised of a collection box (12) having a rectangular frame (14) with an open front (16), side walls (18), rear walls (20), an open top (22), an open bottom (24) and a pivotally mounted plow saddle (26). The front (28) of the frame (14) is provided with multiple hitch points (30) for attachment of the apparatus (10) to the hitch links (116) of a standard tractor hitch (118) having a hitch lift (120) provided on the tractor (100). The use of multiple hitch points (30) allows the apparatus (10) to be used with both small and large horsepower tractors. While it is thought that the frame (14) will be rectangular in shape a frame of any suitable geometric configuration such as a trapezoidal or cylindrical frame may be utilized.

Figure 8:
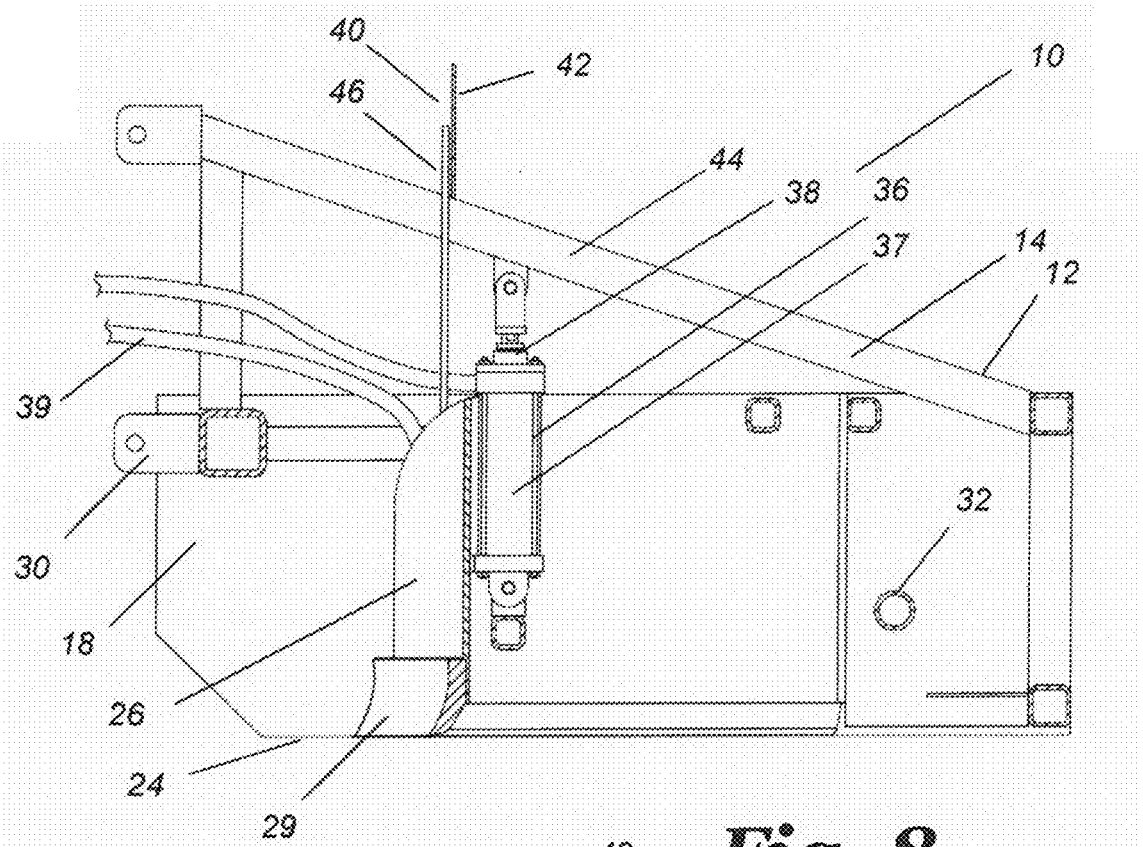
FIG. 8 is a sectional elevation view of the ditch cutting and excavation spoil removal apparatus cut on line 8-8 as depicted in FIG. 7 showing the plow saddle and plowshare in an upward elevated position.
Figure 9:
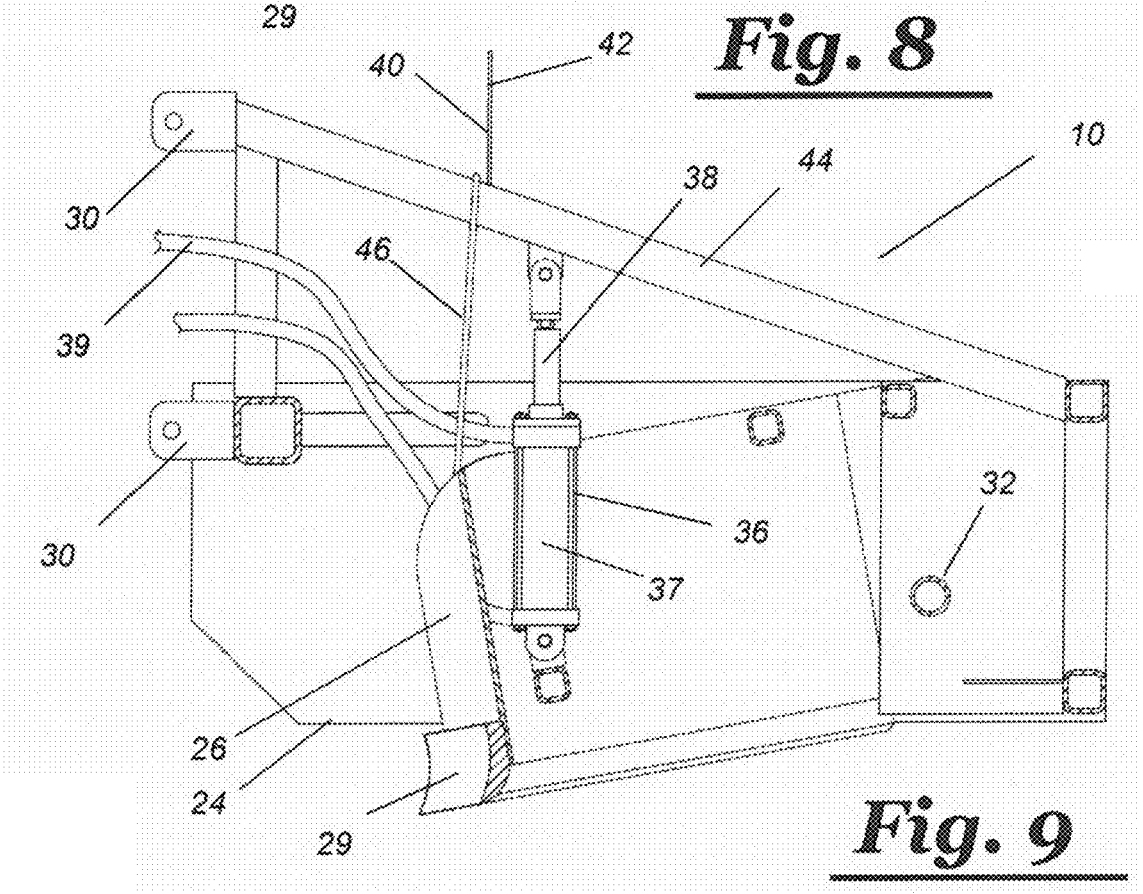
FIG. 9 is a sectional elevation view of the ditch cutting and excavation spoil removal apparatus cut on line 8-8 as depicted in FIG. 7 showing the plow saddle and plowshare in a downward lowered position.

The plow saddle (26), shown in detail in FIGS. 8 and 9, is pivotally mounted within the frame (14) of the collection box (12) on a transversely extending plow pivot bar (32). The pivot bar (32) allows the forward end cutting end (27) of plow saddle (26) to be retracted and extended from the bottom (24) of the collection box (12) by tilting or pivoting the plow saddle (26) upward and downward on the pivot bar (32). A V-shaped blade or plowshare (29) is mounted at the base (25) of the plow saddle (26) to facilitate excavation of the furrow (140). Attachment bolts or screws (34) may be used to removably mount the plowshare (29) to the plow saddle (26) to facilitate its replacement or maintenance. The plow saddle (26) and pivot bar (32) allow pivotal adjustment of the depth of plowshare (29) with respect to the ground surface (142) and, correspondingly, the depth of the furrow (140) being cut when the apparatus (10) is in use.

Upward and downward pivotal movement of the plow saddle (26) is controlled by plow lift (36). Preferably, plow lift (36) will be a double acting hydraulic cylinder linear actuator (37) having an extendable and retractable piston rod (38), the actuator (37) and piston rod (38) being pivotally attached between the plow saddle (26) and the frame (14) as shown in FIG. 8 and FIG. 9. Engaging the linear actuator (37) of plow lift (36) to extend and retract the piston rod (38) tilts or pivots the plow saddle about pivot bar (32) upward and downward through the open bottom of the collection box (12).

The plow lift (36) will allow for on-the-go adjustment of the depth of plowshare (29) and, correspondingly, the depth of the furrow (140) during use. The plow lift (36) will have hydraulic fluid lines (39) with standardized connectors suitable for connection with the hydraulic system provided with the tractor (100). While it is thought that the plow lift (36) will include a double acting hydraulic cylinder linear actuator (37), other types of linear actuators may also be utilized. Such other linear actuators may be mechanical actuators, electro/mechanical actuators, or pneumatic actuators.

The apparatus (10) may be provided with a depth indicator (40). In the embodiment shown in FIGS. 7, 8, and 9, the depth indicator is comprised of a vertically extending graduated rule (42) mounted on a support bar (44) at the top (22) of the frame (14) and a vertically extending L-shaped indicator rod (46) mounted on the plow saddle (26). Upward and downward movement of the plow saddle (26) about pivot bar (32) by means of the plow lift (36) will move the L-shaped indicator rod (46) upward and downward along the length of the graduated rule (42) to indicate the position or elevation of the plowshare (29) with respect to the frame (14) and the ground surface (142) of the field (144).

The frame (14) of the collection box (12) may also have a runner (33) that extends along the base (23) of each side wall (24) to facilitate sliding movement of the apparatus (10) along the ground surface (142) of the field (144). A flat scraper blade (35) that extends along the base (31) of the rear wall (26) of the frame (14) of the collection box (12) may also be provided to facilitate collection of the excavation spoil (146) and its movement into the collection box (12).

For use the ditch cutting and excavation spoil removal apparatus (10) is attached to the hitch links (116) of tractor hitch (118). The hitch lift (120) of the tractor hitch (118), typically, a single acting hydraulic cylinder actuator, is then activated to lift the collection box (12) so that it is no longer in contact with the ground surface (142). The tractor (100) with the attached apparatus (10) is then moved to a desired location on the field (144) where the ditching operation is to commence.

As shown in FIG. 3, the hitch lift (120) of the tractor hitch (118) is then deactivated to lower the collection box (12) of the apparatus (10) so that it is in contact with the ground surface (142). The plow lift (36) is then activated to tilt the pivotally mounted plow saddle (26) downward to correspondingly place the plowshare (29) at a desired position with respect to the frame (14) and the ground surface (142). The tractor (100) is then moved forward to engage the plowshare (29) with the ground surface (142) to cut the furrow or ditch (140). As the tractor (100) moves forward, the excavation spoil (146) from the newly cut ditch (140) is moved upward and outward away from the plow saddle (26) and plowshare (29) and collected within the excavation collection box.

The excavation spoil (146) may then be removed from the excavation collection box (12) of the apparatus (10) by activating the double acting cylinder (37) of the plow lift (36) to tilt or pivot the plow saddle (26) and plowshare (29) upward as shown in FIG. 8 and then dragging the apparatus (10) to a desired location. The excavation collection box (12) may then be lifted to a desired position above the ground surface (142) by activation of the tractor's hitch lift (120) as shown in FIG. 3*b* so that the collected excavation spoil (146) will by disbursed from the open bottom (24) of the excavation collection box (12).

Figure 10:
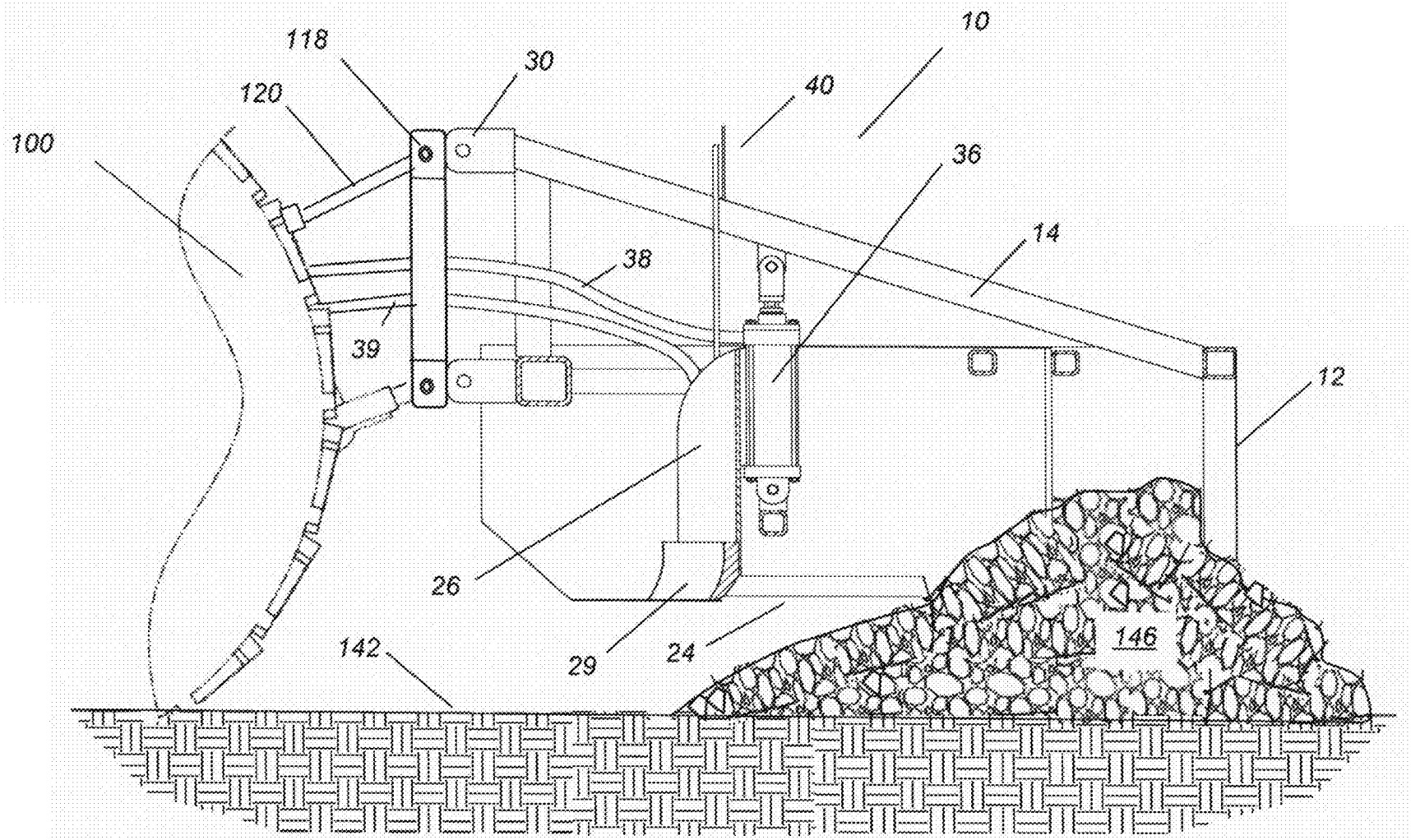
FIG. 10 is a sectional elevation view of the ditch cutting and excavation spoil removal apparatus cut on line 8-8 as depicted in FIG. 7 showing the spreading of the collected excavation spoil with the plow saddle and plowshare and the excavation collection box in an upward position.

The disbursed excavation spoil (146) may then be spread along the ground surface (142) as desired, as shown in FIG. 10, by moving the tractor (100) forward or rearward to push and pull the elevated excavation collection box (12) over the disbursed excavation spoil. Adjusting the elevation of the excavation collection box (12) by means of the tractor hitch lift (120) controls the amount and depth of the excavation spoil (146) as it is being spread along the ground surface.

In an alternate method of use, the apparatus (10) may also be used to scape, collect and remove previously cut excavation spoil (146) for deposit elsewhere. This is done by activating the double acting cylinder (37) of the plow lift (36) to tilt or pivot the plow saddle (26) and plowshare (29) upward as shown in FIG. 8. The tractor (100) is then used moving the apparatus (10) where it is to be used to remove previously cut excavation spoil (146). Then, by deactivating the tractor hitch (118) to lower the collection box (12) of the apparatus (10) so that it is in contact with the ground surface (142), the apparatus may be pulled across the ground surface over any previously cut excavation spoil (146) for collection, removal, and deposit elsewhere in the same manner as previously described.

It will be evident that various other changes may be made in the form, construction and arrangement of the parts and steps of the apparatus and method described herein without departing from the spirit, scope, and material advantages of the invention. It is also thought that the method and apparatus presented herein will be understood from the foregoing description and that the forms and steps described herein are intended to be merely exemplary embodiments of the invention.

I claim:

1. A method for cutting ditches and simultaneously removing excavation spoil comprising the steps of:

(a) providing a tractor having a vertically adjustable hitch lift;

(b) providing a ditch cutting and excavation spoil removal apparatus comprising:

(i) an excavation spoil collection box having a frame, an open front, closed side walls, a closed rear wall, and an open bottom;

(ii) a plow saddle pivotally mounted within said frame, said plow saddle having an attached plowshare;

(iii) a linear actuator pivotally attached between said frame and said plow saddle whereby said plow saddle with said attached plowshare may be pivotally positioned upward and downward from said bottom of said excavation spoil collection box by engaging said linear actuator; and (iv) a plurality of hitch points whereby said hitch lift of said tractor may be selectively attached;

(c) attaching said hitch points of said ditch cutting and excavation spoil removal apparatus to said hitch lift of said tractor whereby said excavation spoil collection box may be raised and lowered;

(d) raising said hitch lift of said tractor thereby raising said spoil collection box of said ditch cutting and excavation spoil removal apparatus;

(e) engaging said linear actuator thereby pivotally positioning said plow saddle with said plowshare upward within said spoil collection box;

(f) moving said tractor and said attached ditch cutting and excavation spoil removal apparatus to a ground surface where a ditch is required;

(g) lowering said hitch lift of said tractor thereby lowering said excavation spoil collection box to said ground surface;

(i) engaging said linear actuator thereby pivotally positioning said plow saddle with said plowshare downward through said bottom of said excavation spoil collection box thereby engaging said plow saddle with said plowshare with said ground surface; and (j) moving said tractor on said ground surface thereby pulling said plow saddle with said plowshare of said ditch cutting and excavation spoil removal apparatus whereby a ditch and excavation spoil is created and whereby said excavation spoil is simultaneously collected and retained within said excavation spoil collection box.

2. The method for cutting ditches and simultaneously removing excavation spoil recited in claim 1 further comprising the additional steps of:

(a) engaging said linear actuator thereby pivotally positioning said plow saddle with said plowshare upward into said spoil collection box;

(b) moving said tractor on said ground surface thereby pulling said ditch cutting and excavation spoil removal apparatus with said collected excavation spoil to a desired location on said ground surface;

(c) raising said hitch lift of said tractor thereby lifting said excavation spoil collection box from said ground surface thereby disbursing said collected excavation spoil; and (d) moving said tractor on said ground surface thereby pulling and pushing said excavation spoil collection box over said disbursed excavation spoil thereby spreading said disbursed excavation spoil.

* * * * *